US011152755B2

(12) United States Patent
Naka et al.

(10) Patent No.: US 11,152,755 B2
(45) Date of Patent: Oct. 19, 2021

(54) CONNECTOR DEVICE MANUFACTURING METHOD

(71) Applicant: Mitsubishi Electric Corporation, Tokyo (JP)

(72) Inventors: Shinji Naka, Tokyo (JP); Keigo Okada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 97 days.

(21) Appl. No.: 16/085,678

(22) PCT Filed: Apr. 19, 2016

(86) PCT No.: PCT/JP2016/062303
§ 371 (c)(1),
(2) Date: Sep. 17, 2018

(87) PCT Pub. No.: WO2017/183090
PCT Pub. Date: Oct. 26, 2017

(65) Prior Publication Data

US 2019/0097375 A1 Mar. 28, 2019

(51) Int. Cl.
*H01R 43/00* (2006.01)
*H01R 43/24* (2006.01)
(Continued)

(52) U.S. Cl.
CPC ..... *H01R 43/24* (2013.01); *H01R 13/502* (2013.01); *H01R 13/504* (2013.01);
(Continued)

(58) Field of Classification Search
CPC .. H01R 13/514; H01R 13/502; H01R 13/504; H01R 13/5202; H01R 2201/26; H01R 43/005; H01R 43/18; H01R 43/24
See application file for complete search history.

(56) References Cited

U.S. PATENT DOCUMENTS 9,001,516 B2 * 4/2015 Nakayama ..... H05K 5/0073 361/747
10,027,051 B1 * 7/2018 Manushi ..... H01R 13/504
(Continued)

FOREIGN PATENT DOCUMENTS

EP 2 500 996 A1 9/2012
JP 4551166 B2 9/2010
JP 5377710 B2 12/2013

OTHER PUBLICATIONS

Communication dated Aug. 27, 2019 issued by the State Intellectual Property Office of People's Republic of China in counterpart Application No. 201680084531.0.
(Continued)

*Primary Examiner* — Paul D Kim
(74) *Attorney, Agent, or Firm* — Sughrue Mion, PLLC; Richard C. Turner

(57) ABSTRACT

A connector device having a multiple of connector connection terminals of differing connector frontage forms is such that when there is a change in a disposition of a connector frontage, or when using a different connector connection terminal, there is a need to newly prepare a molding die for the whole device. Because of this, the invention includes a first step of fabricating an integrally molded article including a connector connection terminal, forming a connector housing by integrating a multiple of integrally molded articles fabricated in the first step, and forming a connector frontage corresponding to each integrally molded article.

8 Claims, 9 Drawing Sheets

(51) Int. Cl.

| | |
|---|---|
| ***H01R 13/504*** | (2006.01) |
| ***H01R 43/18*** | (2006.01) |
| ***H01R 13/514*** | (2006.01) |
| ***H01R 13/502*** | (2006.01) |
| ***H01R 13/52*** | (2006.01) |

(52) U.S. Cl.
CPC ..... *H01R 13/514* (2013.01); *H01R 13/5202* (2013.01); *H01R 43/005* (2013.01); *H01R 43/18* (2013.01); *H01R 2201/26* (2013.01)

(56) References Cited

U.S. PATENT DOCUMENTS

| | | | | |
|---|---|---|---|---|
| 10,707,609 | B2 * | 7/2020 | Inoue | H01R 13/5219 |
| 2008/0012173 | A1 | 1/2008 | Asao | |
| 2008/0210952 | A1 * | 9/2008 | Wada | H01L 31/0203 257/82 |
| 2009/0023345 | A1 | 1/2009 | Matsumoto et al. | |
| 2010/0081309 | A1 * | 4/2010 | Voli | H01R 13/6275 439/275 |
| 2012/0238134 | A1 | 9/2012 | Matsuoka et al. | |
| 2013/0313929 | A1 | 11/2013 | Naka et al. | |
| 2014/0030556 | A1 * | 1/2014 | Beer | H01R 13/112 429/7 |
| 2016/0020546 | A1 | 1/2016 | Kaesser et al. | |
| 2018/0019544 | A1 * | 1/2018 | Ishibashi | H01R 13/02 |

OTHER PUBLICATIONS

International Search Report for PCT/JP2016/062303 dated Jul. 12, 2016.
Communication dated Jun. 4, 2019 from European Patent Office in counterpart EP Application No. 16899364.0.
Communication dated Sep. 21, 2020, from the European Patent Office in application No. 16899364.0.

* cited by examiner

CONNECTOR DEVICE MANUFACTURING METHOD

CROSS REFERENCE TO RELATED APPLICATIONS

This application is a National Stage of International Application No. PCT/JP2016/062303 filed Apr. 19, 2016.

TECHNICAL FIELD

The present invention relates to a connector device manufacturing method, and in particular, relates to a method of manufacturing a connector device having a multiple of connector frontages.

BACKGROUND ART

Connectors are handled in fields in which various electrical connections are carried out, and are used in order to improve a flow of power or a signal. In particular, connectors provide an advantage in organizing electrical wiring by a multiple of connectors being integrated in a place in which a large number of electrical wires are disposed in a complex manner. For example, as connectors used in a vehicle-use control device, a multiple of wiring structures are integrated, and a multiple of connectors are configured by molding using an insulating resin (Patent Document 1). Also, a connector housing is configured by a multiple of connectors with differing frontage forms (terminal disposition patterns) being integrated, and installed in a control device (Patent Document 2).

CITATION LIST

Patent Literature

Patent Document 1: Japanese Patent No. 4551166
Patent Document 2: Japanese Patent No. 5377710

SUMMARY OF INVENTION

Technical Problem

When a connector housing is configured by a multiple of connectors being integrated, wiring can be organized, because of which there is an advantage in that a maintenance operation becomes easier. Also, because connector frontage forms differ, an advantage is obtained in that a wiring connection error is prevented.

However, an existing connector device is such that connector connection terminal, a connector frontage, and a connector housing are of an integrated structure (a connector housing assembly), resin is injected into a periphery of a metal part forming the connector connection terminal, and a formation method that integrates the metal and the resin is adopted. Because of this, for example, when changing the form of the connector frontage only without changing the form of the connector connection terminal or the connector housing, or when changing the disposition of the connector frontage, a molding die for forming the whole connector device needs to be newly fabricated, and there is a problem in that time is needed for fabricating the molding die, and a problem in that costs for molding die fabrication increase.

The invention has an object of resolving the previously described problems, and providing connector device manufacturing method such that a change in design of a connector device can be carried out swiftly, and moreover, costs can be kept low.

Solution to Problem

A connector device manufacturing method of the invention is characterized by including a first step of fabricating a first integrally molded article having a first connector connection terminal and a second integrally molded article having a second connector connection terminal, a second step of forming a connector housing by integrating the first integrally molded article and the second integrally molded article, and a third step of forming a first connector frontage corresponding to the first integrally molded article and a second connector frontage corresponding to the second integrally molded article in the connector housing.

Advantageous Effects of Invention

According to the connector device manufacturing method according to the invention, specifications of various forms of a connector frontage of a connector device can be responded to by changing only the connector frontage, whereby part standardization can be achieved.

DESCRIPTION OF EMBODIMENTS

First Embodiment

Figure 1:
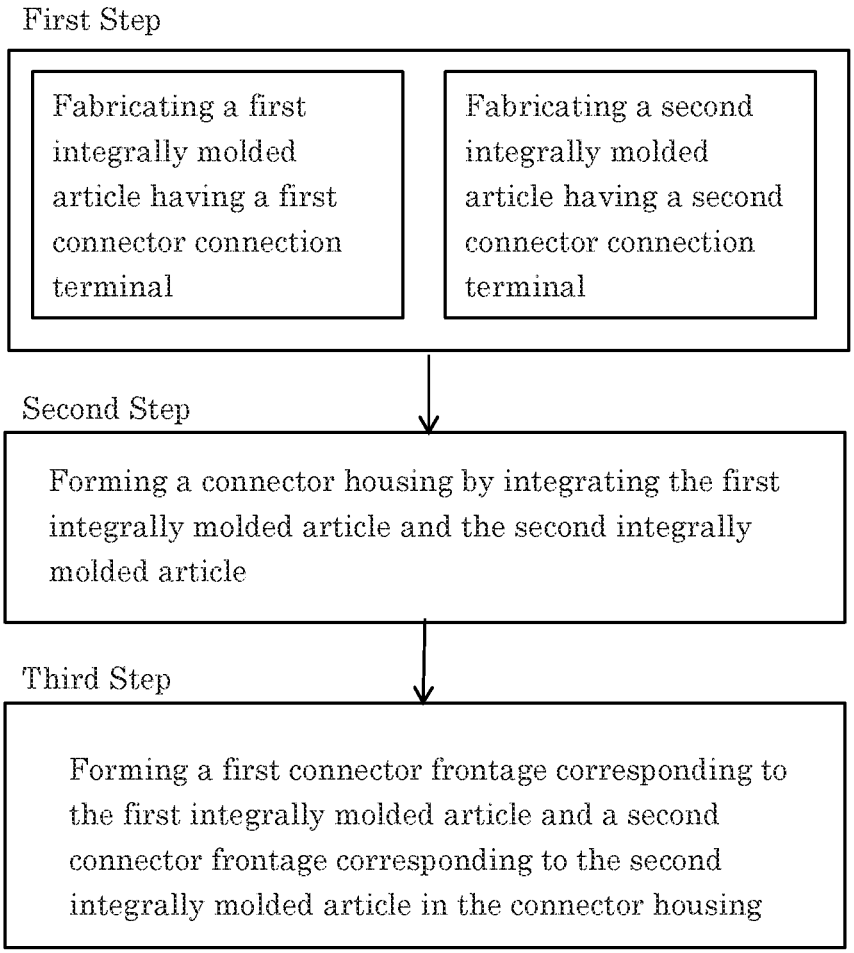
FIG. 1 is a process diagram showing a first embodiment of the invention.

Hereafter, an embodiment of the invention will be described, based on the drawings. As shown in FIG. 1, a connector device manufacturing method of the invention is configured of a first process of fabricating a first integrally molded article having a first connector connection terminal and a second integrally molded article having a second connector connection terminal, a second process of forming a connector housing by integrating the first integrally molded article and the second integrally molded article, and a third process of forming a first connector frontage corresponding to the first integrally molded article and a second connector frontage corresponding to the second integrally molded article in the connector housing.

That is, in the first process, connector connection terminals of various forms are prepared, and integrally molded articles wherein peripheries of the connector connection terminals are hardened using resin are fabricated. For example, integrally molded articles are fabricated by each of connector connection terminals including a connector connection terminal for power supply wiring and a connector connection terminal for signal wiring being hardened with resin.

In the second process, a multiple of the integrally molded articles including the various connector connection terminals fabricated in the first process are gathered and formed into an assembly, further hardened with resin and integrated, thereby forming a connector housing. Herein, a multiple of various kinds of connector connection terminal, or a multiple of the same kind of connector connection terminal, are arbitrarily combined, and integrated by hardening with resin.

In the third process, a connector frontage individually specified in advance is formed in accordance with each connector connection terminal integrated in the connector housing. Herein, insert molding is carried out by individual molding dies corresponding to the connector frontages specified in accordance with the connector connection terminals being used in combination, thereby forming the connector frontage in accordance with each connector connection terminal in the connector housing.

In the first process of the first embodiment of FIG. 1, an individual molding die in accordance with each connector connection terminal is needed in order to form the connector connection terminal into an integrally molded article, but as this is an unchanging molding die rather than a molding die having a whole as a target, the molding die is not newly fabricated. Also, even when the multiple of connector connection terminal integrally molded articles are integrated in the connector housing of the second process, a connector housing molding die is not newly fabricated.

Figure 2:
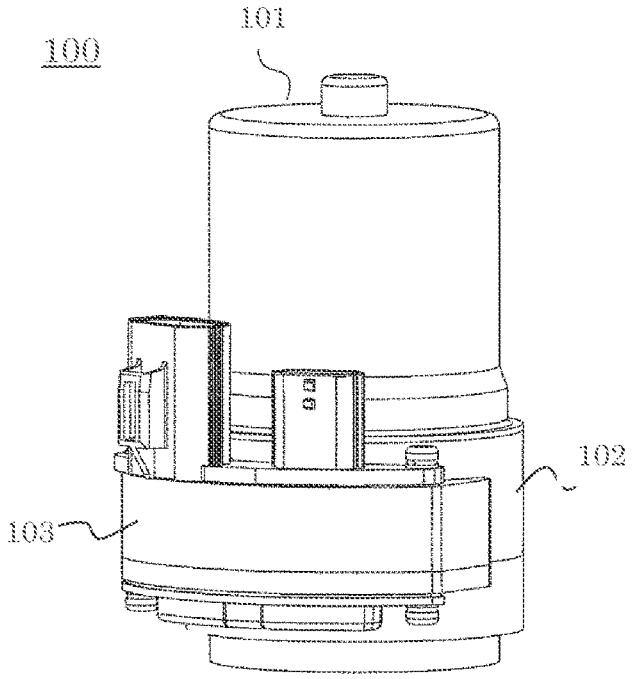
FIG. 2 is a schematic external view of a vehicle-use control device in which a connector device according to the invention is used.

As one example, a connector device manufactured via the processes shown in FIG. 1 is used by being installed in a kind of vehicle-use control device 100 shown in FIG. 2. That is, the vehicle-use control device 100 shown in FIG. 2 is the integrated vehicle-use control device 100 wherein a motor 101 and a control device 102 are integrated, and a connector device 103 shown in FIG. 3 is installed in the vehicle-use control device 100.

Figure 3:
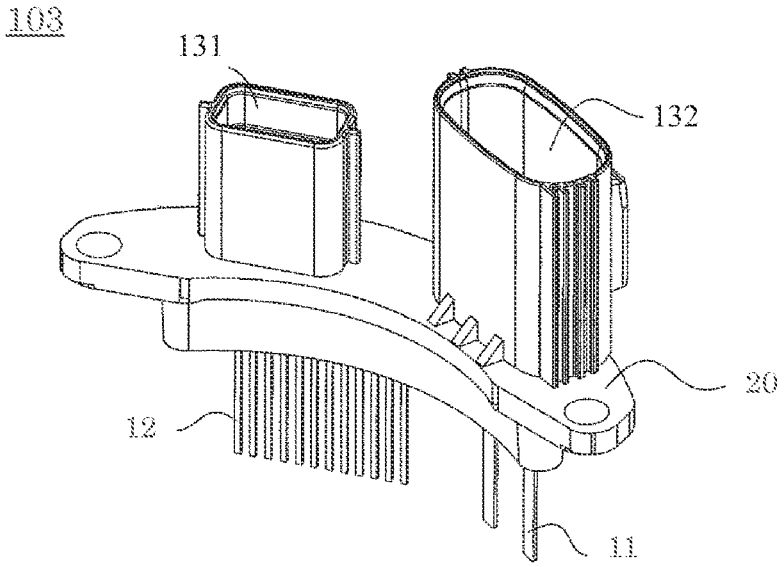
FIG. 3 is an external view of the connector device that is the target of the invention.

The connector device 103 shown in FIG. 3 is commonly called an external connection connector, and as a structure thereof, a first connector connection terminal 11 and a second connector connection terminal 12 are integrated with a connector housing 20, a first connector frontage 131, and a second connector frontage 132. The first connector connection terminal 11 and the second connector connection terminal 12 are electrically connected to the control device 102 shown in FIG. 2. Also, wiring (not shown) from an exterior is connected to the first connector frontage 131 and the second connector frontage 132. That is, the connector device 103 electrically connects the wiring from the exterior and the control device 102.

Next, using FIG. 4 to FIG. 14, a description will be given of a method such that even when changing a connector frontage form of the connector device 103, there is no need to newly fabricate a molding die configuring the whole of the connector device 103.

Figure 4:
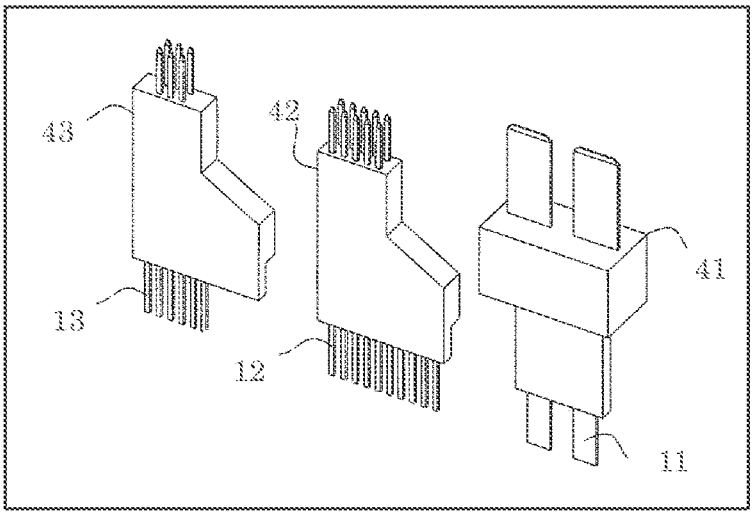
FIG. 4 is a perspective view of a connector connection terminal integrally molded article in the first embodiment.

Using FIG. 4, a description will be given adopting a case in which there are three kinds of connector connection terminal. Firstly, the case shown in FIG. 4, being multiple kinds of connector connection terminal fabricated using the first process of the first embodiment of the invention, is such that the first connector connection terminal 11, the second connector connection terminal 12, and a third connector connection terminal 13 are each insert molded, and a connector connection terminal (power supply) integrally molded article 41 and connector connection terminal (signal) integrally molded articles 42 and 43 are fabricated.

Figure 5:
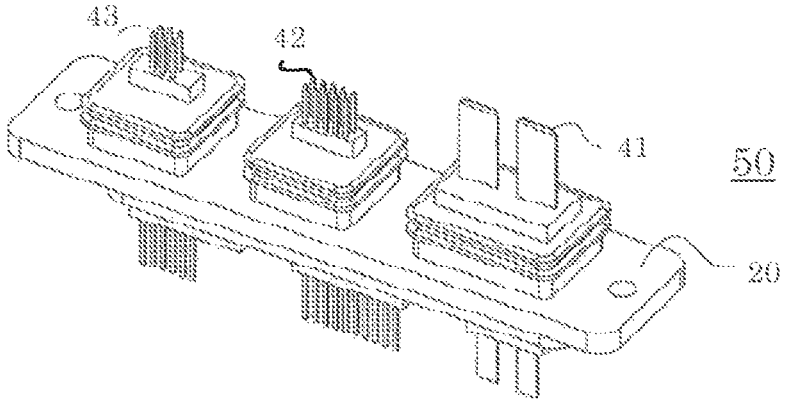
FIG. 5 is a perspective view of a connector housing assembly in the first embodiment.

Subsequently, using the second process, the connector connection terminal (power supply) integrally molded article 41 and the connector connection terminal (signal) integrally molded articles 42 and 43 are insert molded so as to be enclosed in the connector housing 20, thereby fabricating a connector housing assembly (connector housing component) 50. The fabricated connector housing assembly 50 is shown in FIG. 5.

Figure 6:
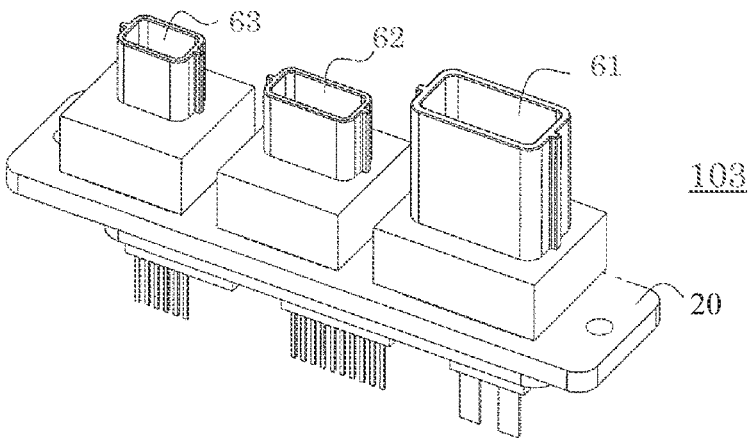
FIG. 6 is a perspective view of the connector device in the first embodiment.

Furthermore, using the third process, molding of a first connector frontage 61, a second connector frontage 62, and a third connector frontage 63 is carried out in accordance with the connector connection terminal (power supply) integrally molded article 41 and the connector connection terminal (signal) integrally molded articles 42 and 43 respectively, and integrated with the connector housing assembly 50, whereby the connector device 103 is completed, as shown in FIG. 6.

Figure 7:
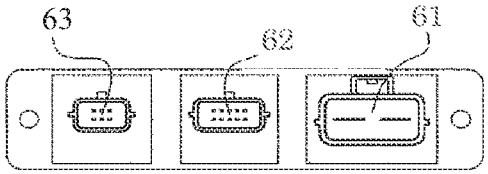
FIG. 7 is a frontage view of the connector device in the first embodiment.

As shown in FIG. 7, the connector device 103 completed in the third process is such that the first connector frontage 61 is a two pin-compatible connector, the second connector frontage 62 is a ten pin-compatible connector, and the third connector frontage 63 is a six pin-compatible connector.

Figure 8:
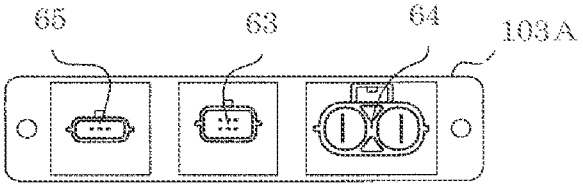
FIG. 8 is a frontage view of the connector device in the first embodiment.

A method of fabricating an external connection connector 103A when, as shown in FIG. 8, the first connector frontage 61 is changed to a fourth connector frontage 64, a position in which the second connector frontage 62 has existed is changed to the third connector frontage 63, and a position in which the third connector frontage 63 has existed is changed to a fifth connector frontage 65, which is a three-pin compatible connector, will be described using FIG. 9 and FIG. 10.

Figure 9:
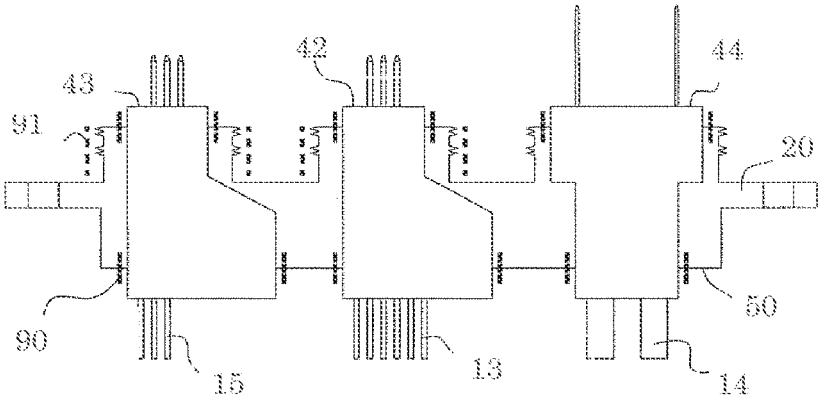
FIG. 9 is a sectional view of the connector device in the first embodiment.

Firstly, as shown in FIG. 9, a fourth connector connection terminal 14 in accordance with the fourth connector frontage 64 is insert molded using resin, thereby fabricating a fourth connector connection terminal (power supply) integrally molded article 44. Also, a connector connection terminal 15 in accordance with the fifth connector frontage 65 is insert molded, thereby fabricating the third connector connection terminal (signal) integrally molded article 43. The connector connection terminal (signal) integrally molded article 42 used in the external connection connector 103 is diverted for use as the connector connection terminal (signal) integrally molded article in accordance with the connector frontage 63. The connector connection terminal (power supply) integrally molded article 44 and the connector connection terminal (signal) integrally molded articles 42 and 43 are integrally molded using the same molding die as for the connector housing 20 used in the external connection connector 103, thereby fabricating the connector housing assembly 50. As a characteristic of forms of the connector connection terminal (power supply) integrally molded article and the connector connection terminal (signal) integrally molded articles for integrally molding using the same molding die as for the connector housing 20, not only a shaped portion of a connector housing seal portion 90, but also overall forms and volumes (both excluding the connector connection terminal portion) of connector connection terminal integrally molded article resin portions are the same, with an object of obtaining constant fluidity when molding the connector housing 20.

Figure 10:
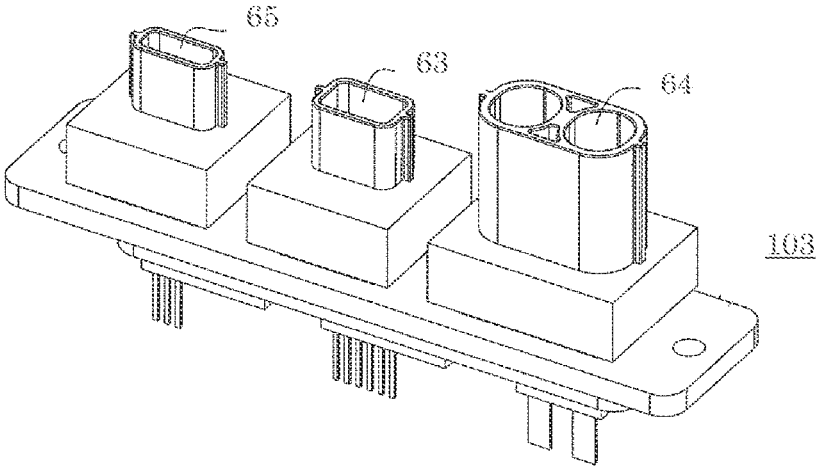
FIG. 10 is a perspective view of the connector device in the first embodiment.

Next, the fourth connector frontage 64, the third connector frontage 63, and the fifth connector frontage 65 are molded, and integrated with the connector housing assembly 50, whereby the connector device 103 is completed, as shown in FIG. 10. At this time, a molding die is newly fabricated for the fourth connector frontage 64 and the fifth connector frontage 65, but the molding die for the second connector frontage 62 used in the connector device 103 is diverted to be used for the third connector frontage 63. The reason the second connector frontage 62 can be diverted to be used is that external connection connector seal portions 91 shown in FIG. 9 are of the same form.

Figure 11:
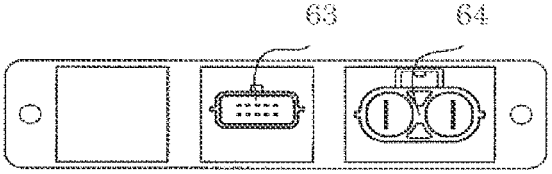
FIG. 11 is a frontage view of the connector device in the first embodiment.

Next, a method of fabricating the connector device 103 when the kind of external connection connector 103A shown in FIG. 11 is such that there is no need to change the fourth connector frontage 64, the third connector frontage 63 is changed to the second connector frontage 62, and the fifth connector frontage 65 is eliminated, will be described using FIG. 12 to FIG. 14.

Figure 12:
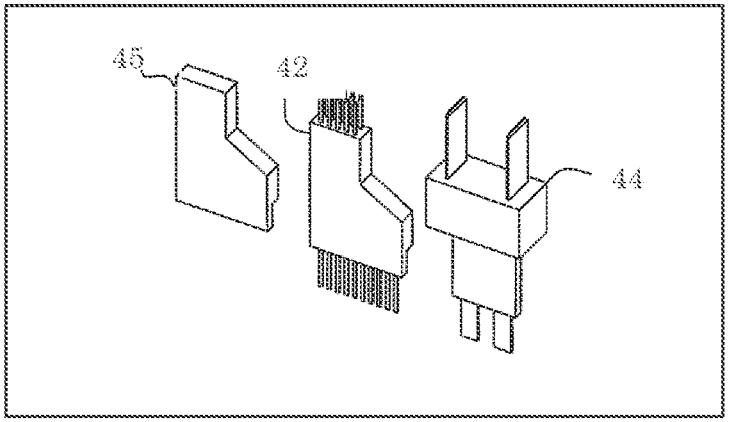
FIG. 12 is a perspective view of a connector connection terminal integrally molded article in the first embodiment.

As shown in FIG. 12, a molded article dummy 45 in which no connector connection terminal is inserted is fabricated for use as a portion in which no connector is provided. This has a function of leaking resin when molding the connector housing 20. As a characteristic of the dummy 45, an overall form and volume (both excluding the connector connection terminal portion) of the connector connection terminal (signal) integrally molded article resin portion are the same, in the same way as the connector connection terminal integrally molded articles. In addition to this, the connector connection terminal (power supply) integrally molded article 44 for the fourth connector frontage 64 used in the connector device 103 and the connector connection terminal (signal) integrally molded article 42 for the second connector frontage 62 used in the connector device 103 are diverted for use as the connector connection terminal integrally molded articles.

Figure 13:
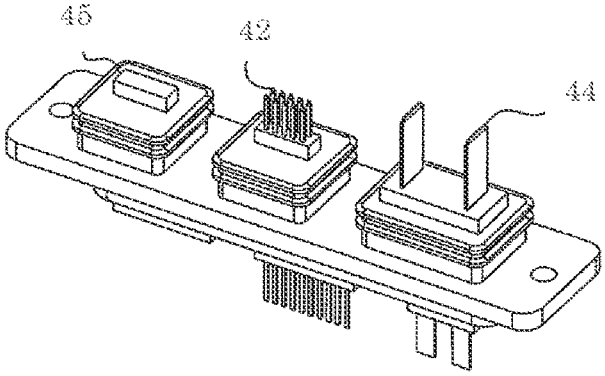
FIG. 13 is a perspective view of a connector housing assembly in the first embodiment.

Next, as shown in FIG. 13, the connector connection terminal (power supply) integrally molded article 44, the connector connection terminal (signal) integrally molded article 42, and the dummy 45 are integrally molded using the same molding die as for the connector housing 20 used in the external connection connector 103, thereby fabricating the connector housing assembly 50.

Figure 14:
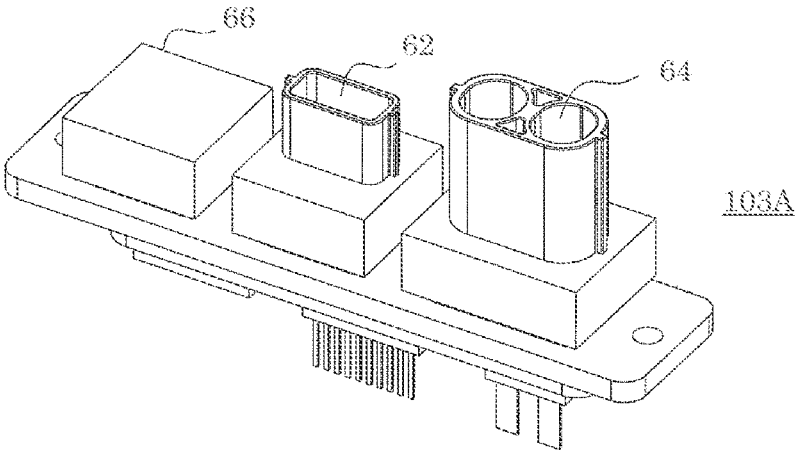
FIG. 14 is a perspective view of the connector device in the first embodiment.

Subsequently, molding of the fourth connector frontage 64, the second connector frontage 62, and a connector cover 66 is carried out, and integrated with the connector housing assembly 50, whereby the external connection connector 103A is completed, as shown in FIG. 14. At this time, a molding die is newly fabricated for the connector cover 66, but the molding die for the fourth connector frontage 64 used in the external connection connector 103A is diverted to be used for the fourth connector frontage 64, and the molding die for the second connector frontage 62 used in the external connection connector 103A is diverted to be used for the second connector frontage 62. The molding die for the connector cover 66 fabricated here can also be diverted to be used elsewhere.

Next, methods of maintaining airtightness of a resin interface between a connector connection terminal integrally molded article and a connector frontage will be described, using FIG. 15 to FIG. 19.

Figure 15:
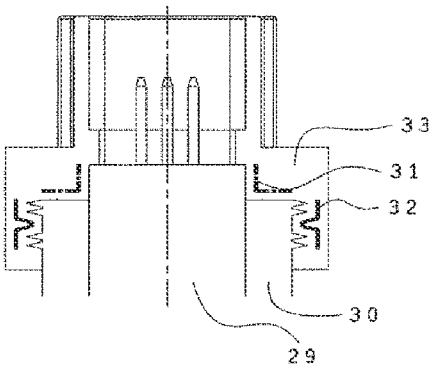
FIG. 15 is a sectional view of a connector frontage portion in the first embodiment.

Firstly, a first method is shown in FIG. 15. In order to maintain airtightness of a resin interface 31 between a connector connection terminal integrally molded article and a connector housing assembly resin portion 30, a labyrinth form 32 is provided in the connector housing assembly resin portion 30. Owing to the labyrinth form 32, a creepage distance to the resin interface 31 after molding of a connector frontage 33 is secured, whereby maintaining of airtightness is realized.

Figure 16:
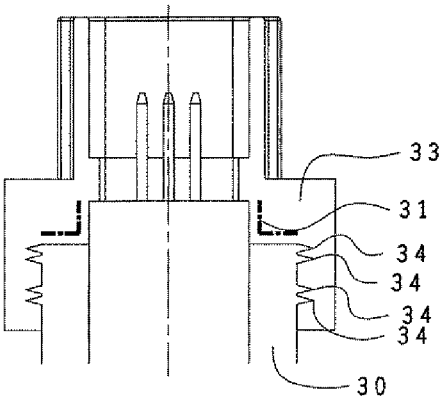
FIG. 16 is a sectional view of a connector frontage portion in the first embodiment.

A second method is shown in FIG. 16 as another method of maintaining airtightness. A rib leading end 34 of the connector housing assembly resin portion 30 is formed in an easily-melted form by being configured more thinly than another portion, or the like, whereby the rib leading end 34 is melted when molding the connector frontage 33, the connector housing assembly resin portion 30 and the connector frontage 33 are integrated, and airtightness of the resin interface 31 is maintained.

Figure 17:
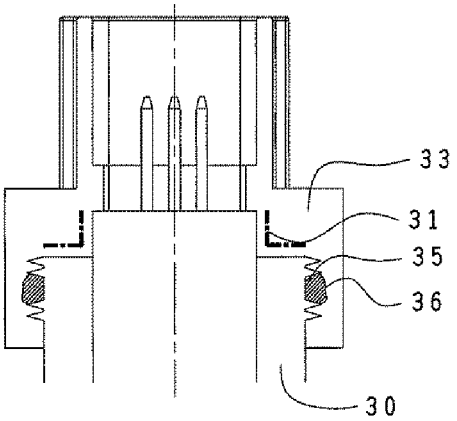
FIG. 17 is a sectional view of a connector frontage portion in the first embodiment.
Figure 18:
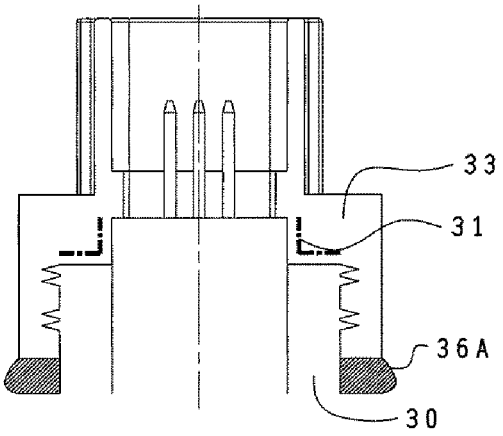
FIG. 18 is a sectional view of a connector frontage portion in the first embodiment.

Furthermore, a third method is shown in FIG. 17 as another method. A seal groove 35 of an uneven structure is provided in the connector housing assembly resin portion 30, and a sealing agent 36 is applied all along the seal groove 35. Subsequently, the connector frontage 33 is molded, and airtightness of the resin interface 31 is maintained. Alternatively, as shown in FIG. 18, a sealing agent 36A is applied all over a resin interface between the connector housing assembly resin portion 30 and the connector frontage 33 after the connector frontage 33 is molded in the connector housing assembly resin portion 30, whereby airtightness of the resin interface 31 is maintained.

Figure 19:
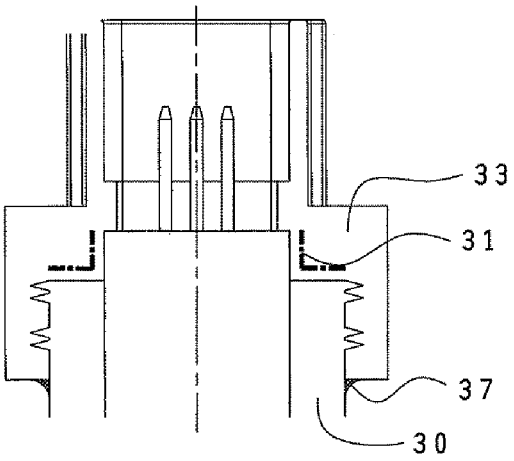
FIG. 19 is a sectional view of a connector frontage portion in the first embodiment.

Further still, a fourth method is shown in FIG. 19 as another method. Heat is applied in a post-processing after the connector housing assembly resin portion 30 and the connector frontage 33 are molded, sealing an interface by subjecting the connector housing assembly resin portion 30 and the connector frontage 33 to a melting 37, and maintaining airtightness of the resin interface 31.

As heretofore described, a connector housing assembly molding die can be diverted for use elsewhere even when only a kind of connector frontage form of the connector device (external connection connector) 103 is changed. Also, a connector frontage molding die, and a connector connection terminal and a connector connection terminal integrally molded article corresponding thereto, can also be diverted for use elsewhere. Furthermore, measures can also be taken when airtightness needs to be maintained, as shown in FIG. 15 to FIG. 19.

The embodiments of the invention can be freely combined, and each embodiment can be modified or abbreviated as appropriate, without departing from the scope of the invention.

The invention claimed is:

1. A connector device manufacturing method, comprising:

a first step of fabricating a first integrally molded article having a first connector connection terminal and a second integrally molded article having a second connector connection terminal;

a second step of forming a connector housing by integrating the first integrally molded article and the second integrally molded article such that the connector housing encloses the first and second integrally molded articles;

a third step of forming a first connector frontage on the first integrally molded article and a second connector frontage on the second integrally molded article in the connector housing; and connecting an external wiring to the first connector frontage and the second connector frontage.

2. The connector device manufacturing method according to claim 1, further comprising forming a labyrinth structure of an uneven form in an outer peripheral portion of the first integrally molded article and the second integrally molded article, wherein maintaining of airtightness is carried out in the third step.

3. The connector device manufacturing method according to claim 1, having a rib portion of a ribbed structure in an outer peripheral portion of the first integrally molded article and the second integrally molded article, wherein maintaining of airtightness is carried out in the third step by causing the rib portion to melt when integrating with the connector housing.

4. The connector device manufacturing method according to claim 1, having a seal groove of an uneven structure in an outer peripheral portion of the first integrally molded article and the second integrally molded article, wherein a sealing agent is applied to the seal groove when integrating with the connector housing, and maintaining of airtightness is carried out in the third step.

5. The connector device manufacturing method according to claim 1, wherein, when the first connector frontage and the second connector frontage are integrated with the connector housing, a first interface between the first connector frontage and the connector housing is melted and a second interface between the second connector frontage and the connector housing is melted.

6. The connector device manufacturing method according to claim 1, further comprising:

fabricating a dummy integrally molded article in the first step;

forming the connector housing by integrating the dummy integrally molded article in addition to the first integrally molded article and the second integrally molded article in the second step; and forming a connector cover corresponding to the dummy integrally molded article in the third step.

7. The connector device manufacturing method according to claim 1, wherein the first integrally molded article, the second integrally molded article, and the connector housing are integrally molded using the same molding die.

8. The connector device manufacturing method according to claim 1, wherein the first and second integrally molded articles are insert molded in the connector housing.

* * * * *